US007150087B2

(12) United States Patent
Maki et al.

(10) Patent No.: US 7,150,087 B2
(45) Date of Patent: Dec. 19, 2006

(54) ROCKER MECHANISM FOR ROCKER RECLINER

(75) Inventors: Gregory J. Maki, Strum, WI (US); Michael J. Dotta, Arcadia, WI (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 0 days.

(21) Appl. No.: 11/184,534

(22) Filed: Jul. 19, 2005

(65) Prior Publication Data

US 2006/0103202 A1 May 18, 2006

Related U.S. Application Data

(63) Continuation of application No. 10/781,516, filed on Feb. 18, 2004, now Pat. No. 6,918,632.

(60) Provisional application No. 60/493,630, filed on Aug. 7, 2003.

(51) Int. Cl.
*B23P 11/00* (2006.01)
*B23P 19/04* (2006.01)

(52) U.S. Cl. ..... 29/434; 29/433

(58) Field of Classification Search ..... 29/434, 29/433, 428, 469, 524.15; 297/259.2, 267.1, 297/258.1, 259.1, 272.1

See application file for complete search history.

(56) References Cited

U.S. PATENT DOCUMENTS

| | | | | |
|---|---|---|---|---|
| 3,190,693 | A | 6/1965 | Underdown | |
| 3,464,736 | A | 9/1969 | Mizelle | |
| 3,767,257 | A | 10/1973 | Rogers, Jr. et al. | |
| 3,802,735 | A | 4/1974 | Ré | |
| 3,815,954 | A | 6/1974 | Rogers, Jr. et al. | |
| 3,904,240 | A | 9/1975 | Rogers, Jr. et al. | |
| 3,938,857 | A | 2/1976 | Craig | |
| 4,057,289 | A | 11/1977 | Jones | |
| 4,071,276 | A | 1/1978 | Cecil | |
| 4,179,157 | A | 12/1979 | Shoemaker et al. | |
| 4,212,494 | A | 7/1980 | Dabney | |
| 4,519,647 | A | 5/1985 | Rogers, Jr. | |
| 4,601,513 | A | 7/1986 | Pine | |
| 4,707,025 | A | 11/1987 | Rogers, Jr. | |
| RE33,704 | E | 10/1991 | Rogers, Jr. | |
| 5,121,967 | A | 6/1992 | Rogers | |
| 5,171,000 | A | 12/1992 | LaPointe et al. | |
| 5,370,442 | A | 12/1994 | Saul et al. | |
| 5,435,622 | A * | 7/1995 | Fay et al. | 297/259.2 |
| 5,490,714 | A * | 2/1996 | de Santis | 297/267.1 |

(Continued)

*Primary Examiner*—John C. Hong
(74) *Attorney, Agent, or Firm*—Patterson, Thuente, Skaar & Christensen, P.A.

(57) ABSTRACT

In preferred embodiments of the invention, rocker cams are positioned intermediate an upper plate assembly and a lower base with a plurality of biasing springs under tension extending between the upper plate assembly and the lower base. Spring retention means are incorporated into the lower base and upper plate assembly providing for direct attachment of the biasing springs thereto obviating the need for spring mechanisms and threaded fasteners for connecting the spring mechanism to the upper plate and lower base. The base comprising a lower support plate configured as a gusseted tray connects to a pair of floor contacting side rails. The upper plate assembly, also preferably configured as a gusseted tray, is fixed to the pair of rocker cams rockingly engaged on the side rails. Vertical flanges are provided on the sides of the upper plate assembly for attaching the reclining mechanism. Each of the upper and lower support plates, in preferred embodiments, are fabricated from plates having elongate edge tabs bent vertically forming strengthening portions. Additional elongate angled recesses are formed in the plates for further strengthening.

13 Claims, 7 Drawing Sheets

U.S. PATENT DOCUMENTS 5,564,781 A * 10/1996 Pine ..... 297/267.1
5,567,009 A 10/1996 Fay et al.
5,876,094 A 3/1999 Hoffman
6,000,754 A 12/1999 Lawson
6,061,891 A 5/2000 Hoffman
6,120,094 A 9/2000 Parent
6,231,120 B1 5/2001 Wiecek
6,244,658 B1 6/2001 Parent et al.
6,309,015 B1 10/2001 Pine
6,634,706 B1 10/2003 May
6,729,686 B1 5/2004 May
6,733,071 B1 5/2004 Guillot et al.

* cited by examiner 64
137.4
68
134
137
48
42
137.4

64
137.6
68
66
50
42
58

139.8
137.1
64
3c
136
122
134
137
139.2
48
120
68
3c
50
139.1

22
64
66
40
46
62
44
62
60
38
54
50

ROCKER MECHANISM FOR ROCKER RECLINER

RELATED APPLICATIONS

This application is a Continuation of U.S. patent application Ser. No. 10/781,516 entitled "Rocker Mechanism for Rocker Recliner", filed Feb. 18, 2004 now U.S. Pat. No. 6,918,632, and also claims the benefit of U.S. Provisional Patent Application Ser. No. 60/493,630 entitled "Rocker Recliner Mechanism", filed Aug. 7, 2003, hereby fully incorporated herein by reference.

FIELD OF THE INVENTION

This invention relates to rocker-recliner chairs and more specifically to mechanisms for rocker-recliner chairs.

BACKGROUND OF THE INVENTION

Rocker-recliner chairs have been a popular home and commercial furniture item for many years. Myriad different rocker-recliner mechanism configurations for rocker-recliners have been developed over time. Examples of prior art rocker-recliner mechanisms, including recliner mechanisms, may be found in U.S. Pat. No. 4,423,903 to Gerth; U.S. Pat. No. 4,519,647 to Rogers; Re 33,704 to Rogers; U.S. Pat. No. 4,544,201 to Rogers; U.S. Pat. No. 4,707,025 to Rogers; U.S. Pat. No. 5,121,967 to Rogers; U.S. Pat. No. 5,171,000 to LaPointe et. al.; U.S. Pat. No. 5,876,094 to Hoffman; U.S. Pat. No. 6,000,754 to Lawson; and U.S. Pat. No. 6,061,891 to Hoffman; all of which are hereby fully incorporated herein by reference.

Prior art rocker-recliner mechanisms typically include a base portion with a pair of floor contacting rails laterally spaced apart and positioned at each side of the chair. A rocker cam rests on each of these rails. A recliner mechanism including a plurality of interconnected pivoting links is connected with each of the rocker cams so as to be rockable in a fore and aft direction. The pair of recliner mechanisms may be connected together and located by one or more bracing members, or may be connected by the chair frame. The mechanisms are usually actuated with a lever-operated shaft that is operably coupled with each mechanism so as to actuate the mechanisms together. One or more spring assemblies may be connected between the base and the rocker cams so as to bias the chair into an upright position and to assist the rocking motion of the chair. A "rocker-blocker" mechanism is sometimes provided to prevent rocking of the chair when the chair is reclined from its fully upright position.

In some of the prior art rocker-recliner mechanisms mentioned above, such as U.S. Pat. Nos. 4,519,647 and 4,707,025, the biasing springs are connected directly between the rocker cam and the floor contacting rails of the base, and the recliner mechanisms are connected with the chair frame with little if any additional bracing between the mechanisms. Such configurations may be relatively heavy and lack lateral and torsional rigidity, thereby causing the overall mechanism to "loosen-up" over time and eventually fail.

Other prior art commercialized mechanisms, such as illustrated in U.S. Pat. No. 6,000,754, have a cross-tube assembly positioned over the base rails and connecting the rocker cams. The biasing spring assemblies are mounted between the cross tube assembly and the base and the recliner mechanisms are connected at each side of the cross tube assembly. Each of the two spring assemblies is comprised of at least four components, two springs, a top cap and a bottom cap. The cross tube assembly is typically fabricated from multiple pieces of square or round metal tubing that are welded together. This cross tube assembly arrangement may be relatively expensive to fabricate due to the need to position together, assemble and weld the multiple tubing pieces and other components. Each of the two spring assemblies must be attached intermediate-the base and cross tube assembly using four screw-nut combinations.

What is needed in the industry is a rocker-recliner mechanism having fewer components facilitating easy fabrication at reduced cost, while maintaining suitable strength.

SUMMARY OF THE INVENTION

In preferred embodiments of the invention, rocker cams are positioned intermediate an upper plate assembly and a lower base with a plurality of biasing springs under tension extending between the upper plate assembly and the lower base. Spring retention means are incorporated into the lower base and upper plate assembly providing for direct attachment of the biasing springs thereto obviating the need for spring mechanisms and threaded fasteners for connecting the spring mechanism to the upper plate and lower base. The base comprising a lower support plate configured as a gusseted tray connects to a pair of floor contacting side rails. The upper plate assembly, also preferably configured as a gusseted tray, is fixed to the pair of rocker cams rockingly engaged on the side rails. Vertical flanges are provided on the sides of the upper plate assembly for attaching the reclining mechanism. Each of the upper and lower support plates, in preferred embodiments, are fabricated from plates having elongate edge tabs bent vertically forming strengthening portions. Additional elongate angled recesses are formed in the plates for further strengthening.

A feature and advantage of the invention is that the rocker mechanism may be manufactured for lower cost with easier assembly and fewer components. An upper plate and lower plate may be principally fabricated in a punch press rather than welded.

A further feature and advantage is that the springs are secured intermediate the upper plate assembly and the base without the use of threaded fasteners that present the problem of coming loose after usage.

A further feature and advantage is that the welded portion of the upper plate assembly and lower base do not require the precision assembly for welding of prior art designs nor is as much stress put on the welded joints as in prior art designs.

A further feature and advantage of the invention is that similar strength of conventional designs may be accomplished with less weight.

DESCRIPTION OF THE INVENTION

Figure 1:
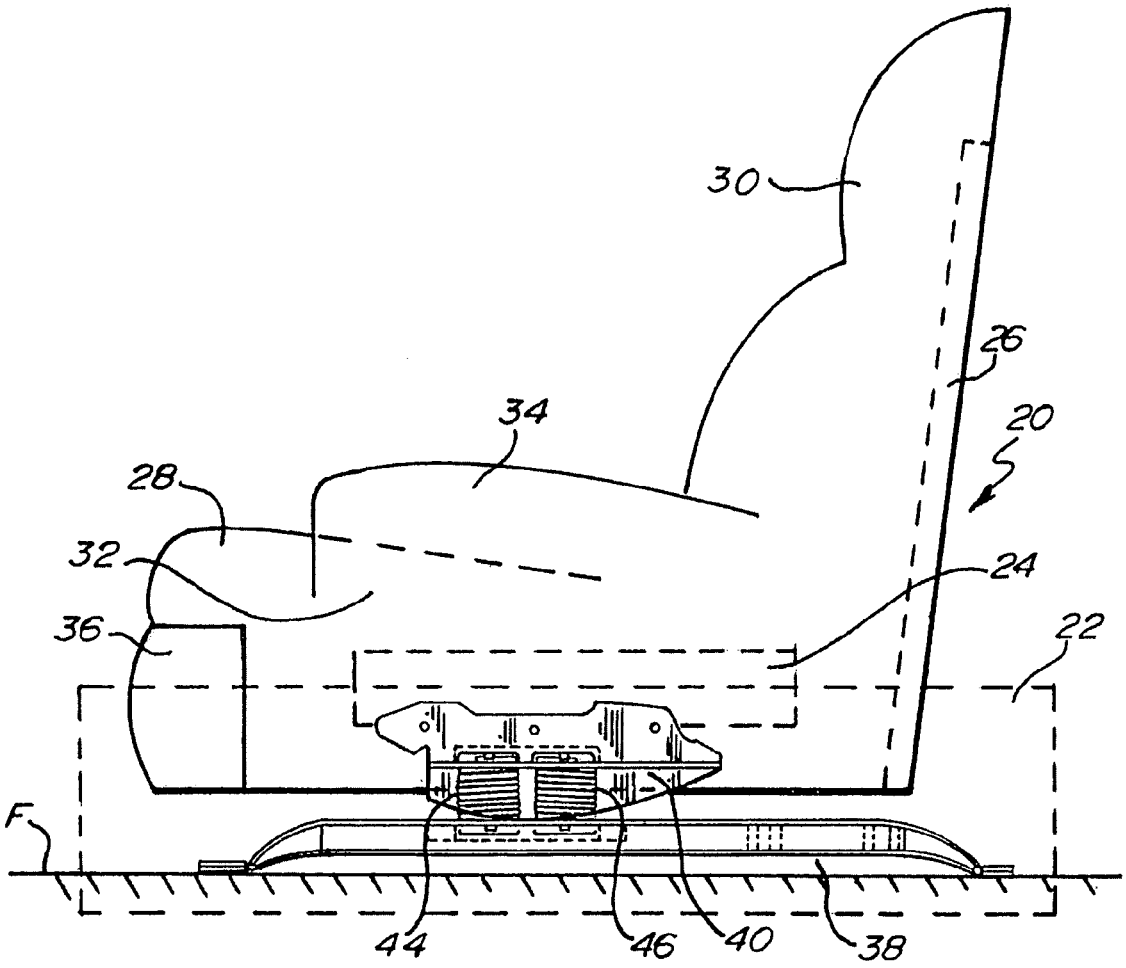
FIG. 1 is a side plan view of a rocker-recliner chair.
Figure 7:
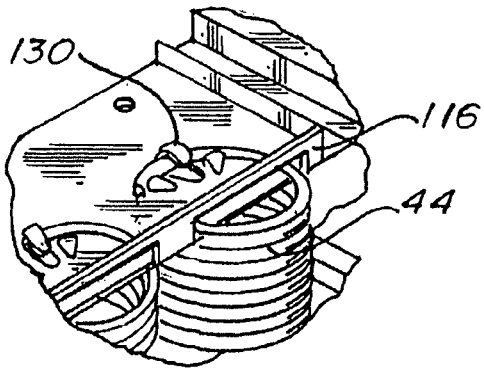
FIG. 7 is a detail perspective view of spring attachment to the upper support plate of the mechanism.
Figure 2:
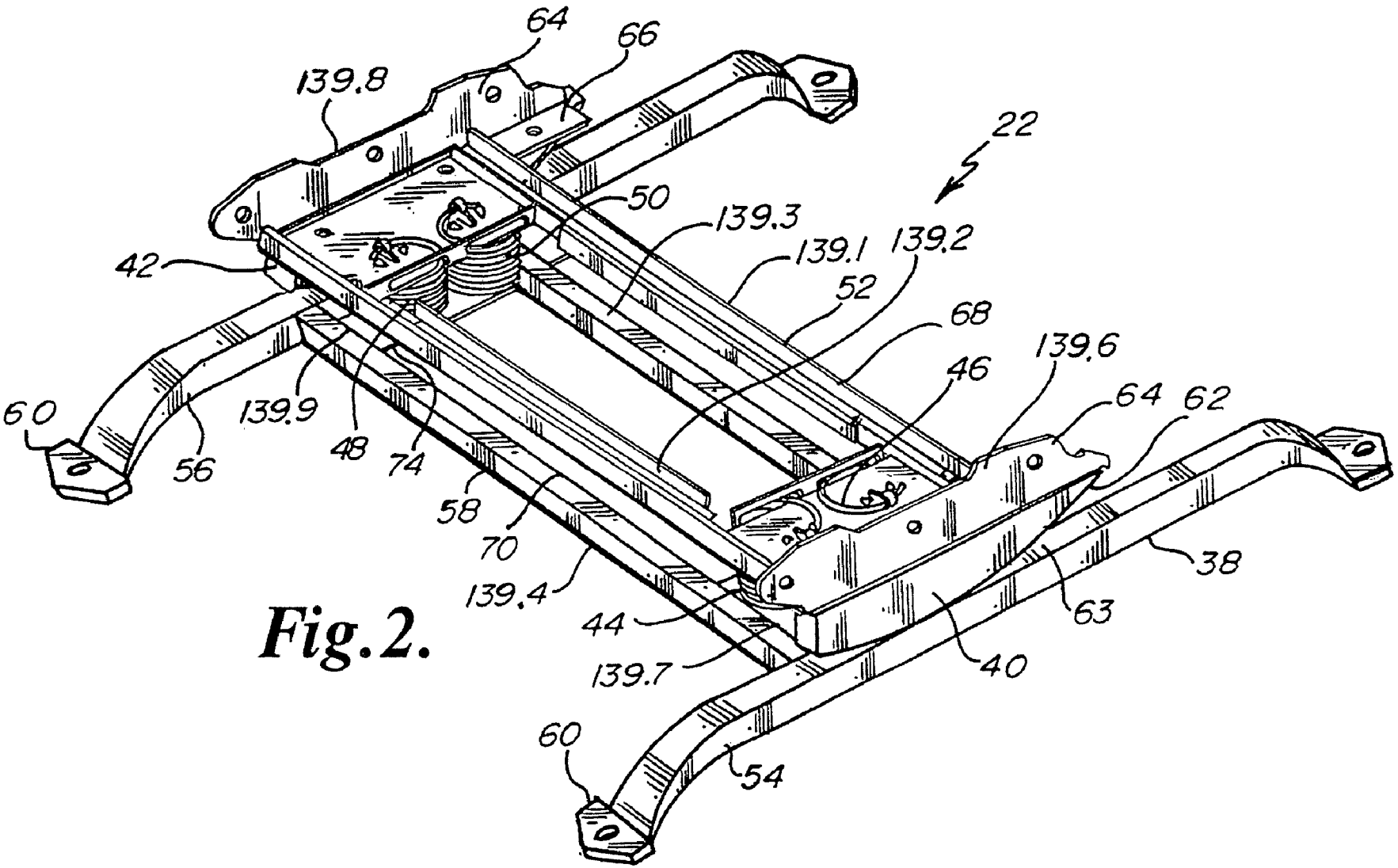
FIG. 2 is a perspective view of a rocker mechanism according to the present invention.

Referring to FIGS. 1 and 2, the invention includes a rocker-recliner chair 20 and, particularly, a rocker mechanism 22. The rocker-recliner chair generally includes a rocker mechanism 22, a recliner mechanism 24 and chair frame 26. The chair frame comprises a seat 28, a backrest 30, sides 32, armrests 34 and a footrest 36. The seat 28, backrest 30, sides 32, armrests 34 and footrest 36 are built within or on a wooden frame 26. The rocker mechanism 22 comprises a base 38, rocker cams 40, 42, bias springs 44, 46, 48, 50 and an upper support plate assembly 52. The recliner mechanism 24 will typically comprise flanges and brackets for attaching a chair frame and may include a lazy tong linkage for attaching a footrest. Various recliner mechanisms are known in the art, such as illustrated in U.S. Pat. Nos. 4,423,903 and 4,662,673. The recliner mechanism 22 is replicated on each side of the chair 20; there being a recliner mechanism 22 on the right side of the chair 20 and a recliner mechanism 22 on the left side of the chair 20.

Figures 3A, 3B, 3C, 4:
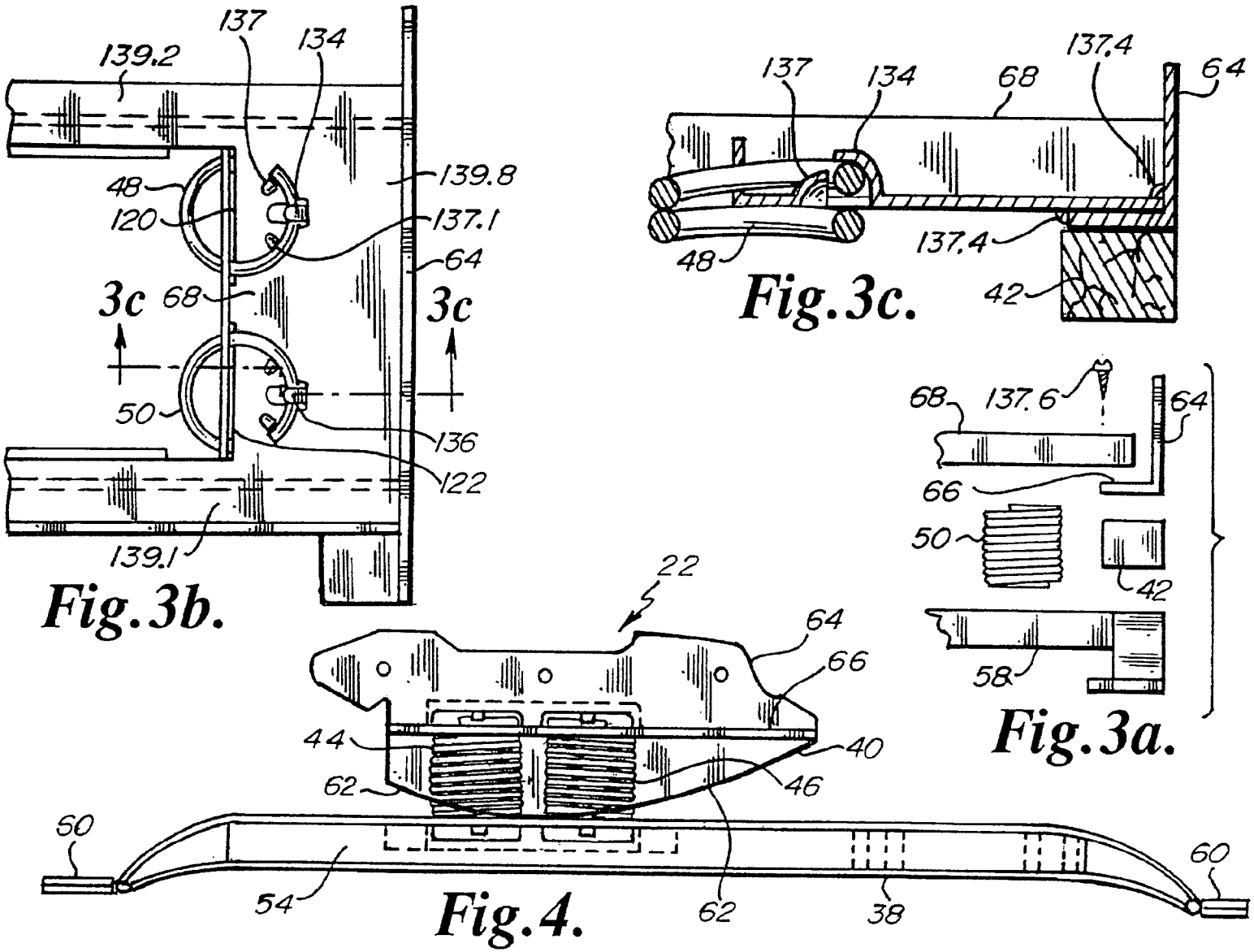
FIG. 3*a* is an exploded elevational view of one side of the rocker assembly.
FIG. 3*b* is a top elevational view of the spring attachment to the upper support plate of the mechanism.
FIG. 3*c* is a cross-sectional view through line 3*c*–3*c* of FIG. 3*b*.
FIG. 4 is a side plan view of the rocker mechanism depicted in FIG. 2.

The base 38 shown generally in FIGS. 1, 2 and 4 comprises a pair of side rails 54, 56 that rest on the floor surface F and a lower support plate 58 configured as a gusseted tray. The side rails 54, 56 are preferably fabricated from square steel tubing. Feet 60 are attached to the ends of the side rails 54, 56 to provide a stabilizing surface and to protect the floor surface on which the base of the chair rests. The lower support plate 58 is preferably welded to the two side rails 54, 56 to form a unitary assembly. The lower support plate 58 can be formed by a punch press from stock plate or sheet metal.

Figure 5:
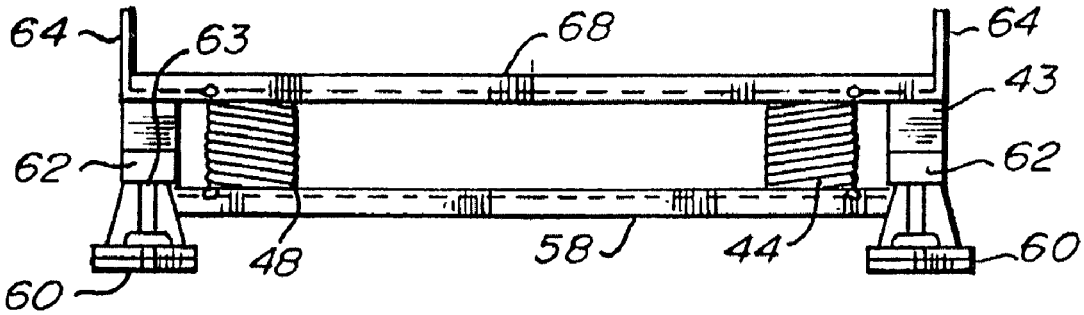
FIG. 5 is a front plan view of the rocker mechanism depicted in FIG. 2.
Figure 6:
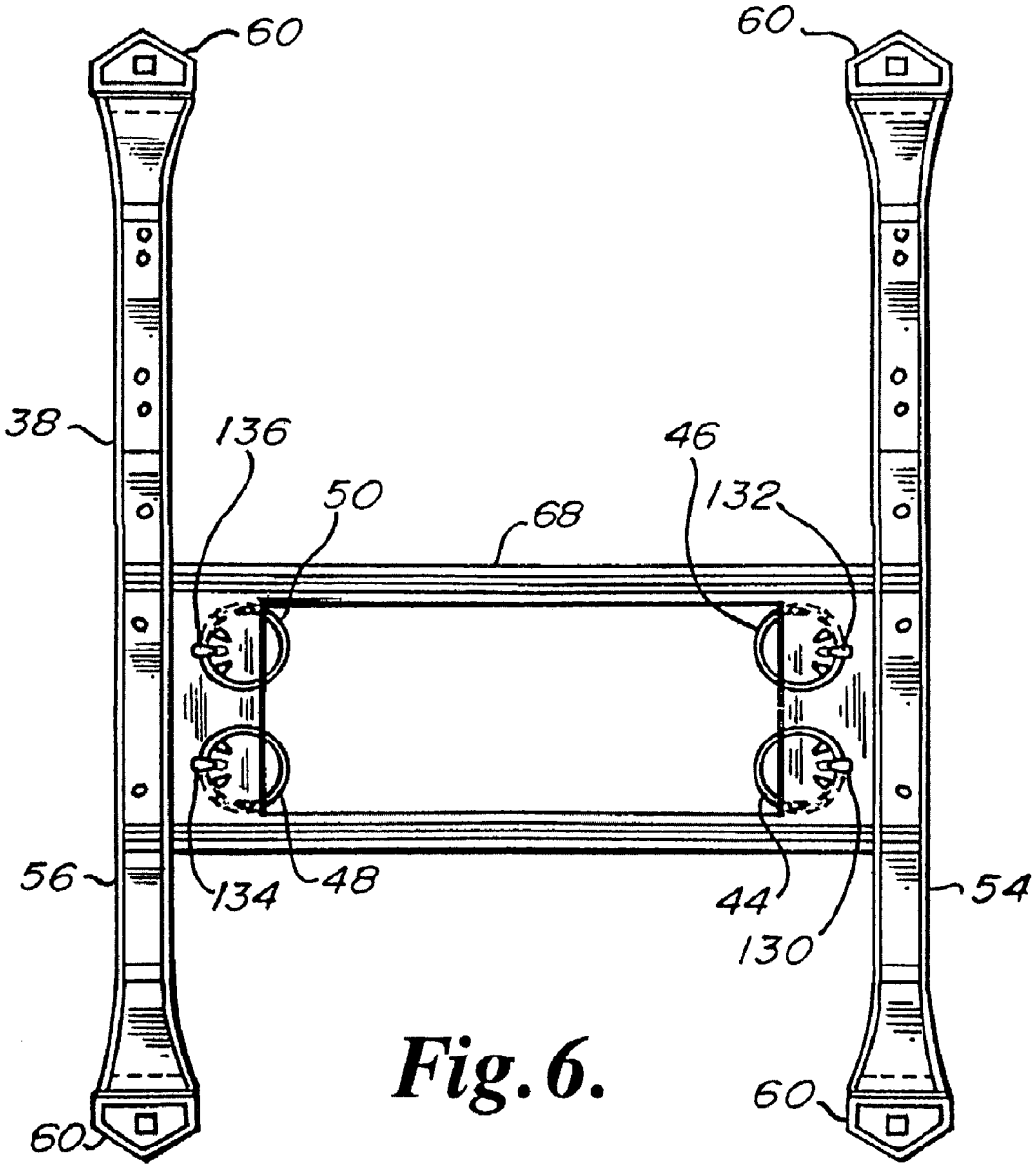
FIG. 6 is a top plan view of the rocker mechanism depicted in FIG. 2.
Figure 9:
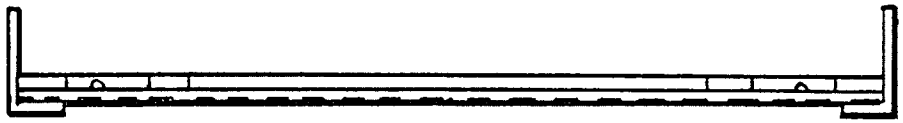
FIG. 9 is a side plan view of the upper support plate.
Figure 11:
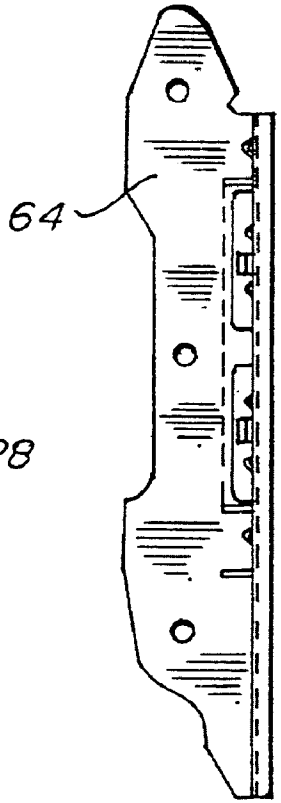
FIG. 11 is a side plan view of the flange attached to the rocker cam.
Figure 8:
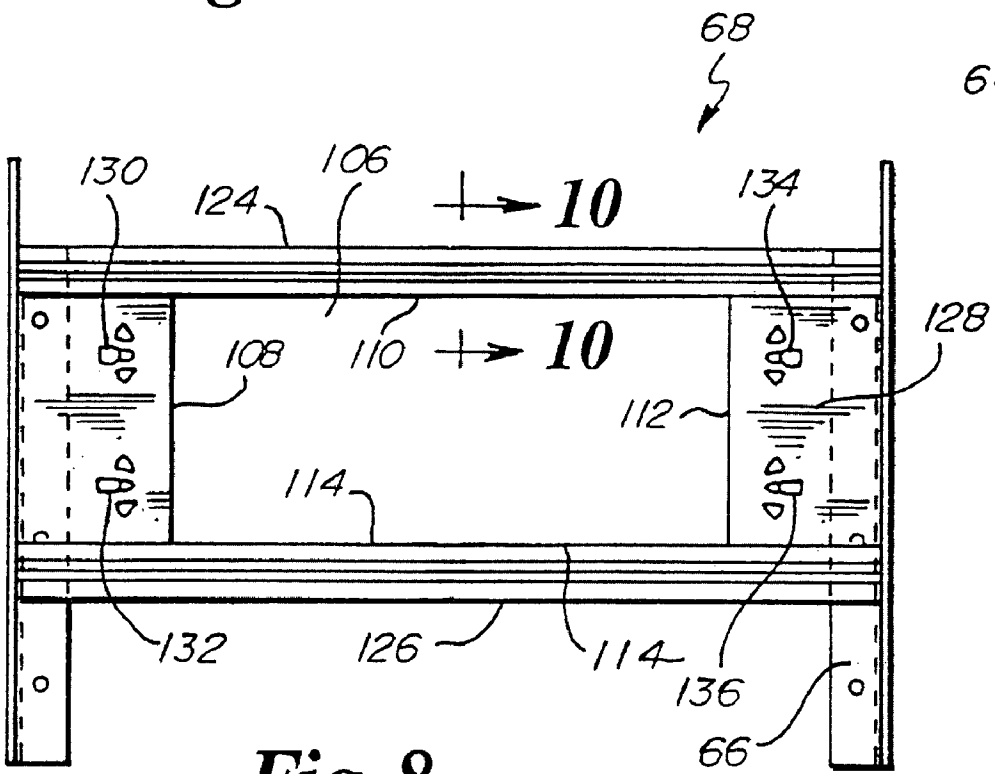
FIG. 8 is a top plan view of the upper support plate.
Figure 10:
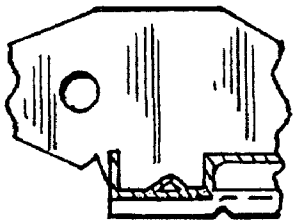
FIG. 10 is a side sectional view of line 10—10 of FIG. 8.

The rocker cams 40, 42 each have a curved bottom surface 62 that allows the rocker-recliner to rock forward and aft. As shown in FIGS. 2, 4, and 5, the curved surface 62 of each rocker cam 40, 42 rocks on the upper surface 63 of the base 38. A rocker cam 40, 42 is located on each side of the chair base 38. Attached to the upper surface 43 of each rocker cam 40, 42 is an upwardly projecting flange portion 64 at the outer margin thereof. The upwardly projecting flange portion 64 is a component of the upper support plate assembly 52 and is preferably formed from a piece of plate stock bent at a right angle with a lower leg 66 or horizontal portion sandwiched between the rocker cam and the metal forming the upper support plate 68. The recliner mechanism is affixed to the flange portions 64 on either side of the chair 20 by conventional fasteners. The horizontal portions 66 of the flange portions 64 are laterally connected to the upper surface of each rocker cam 40, 42. The ends of the upper support plate 68, which is part of the upper support plate assembly 52, are welded to each flange portion 64 so the upper support plate 68 connects the two rocker cams 40, 42. In addition, the upper support plate 68 is affixed by screws, bolts or the like, to the rocker cams 40, 42. Generally, the rocker cams are preferably made of wood, but may also be formed of plastic and the like.

As shown in FIGS. 2–7, the springs 44, 46, 48, 50 are under tension and extend between the lower support plate 58 and the upper support plate 68 and are each attached directly to the lower support plate 58 and the upper support plate 68 by way of attachment means preferrably integrally formed within the respective plates.

Figure 13:
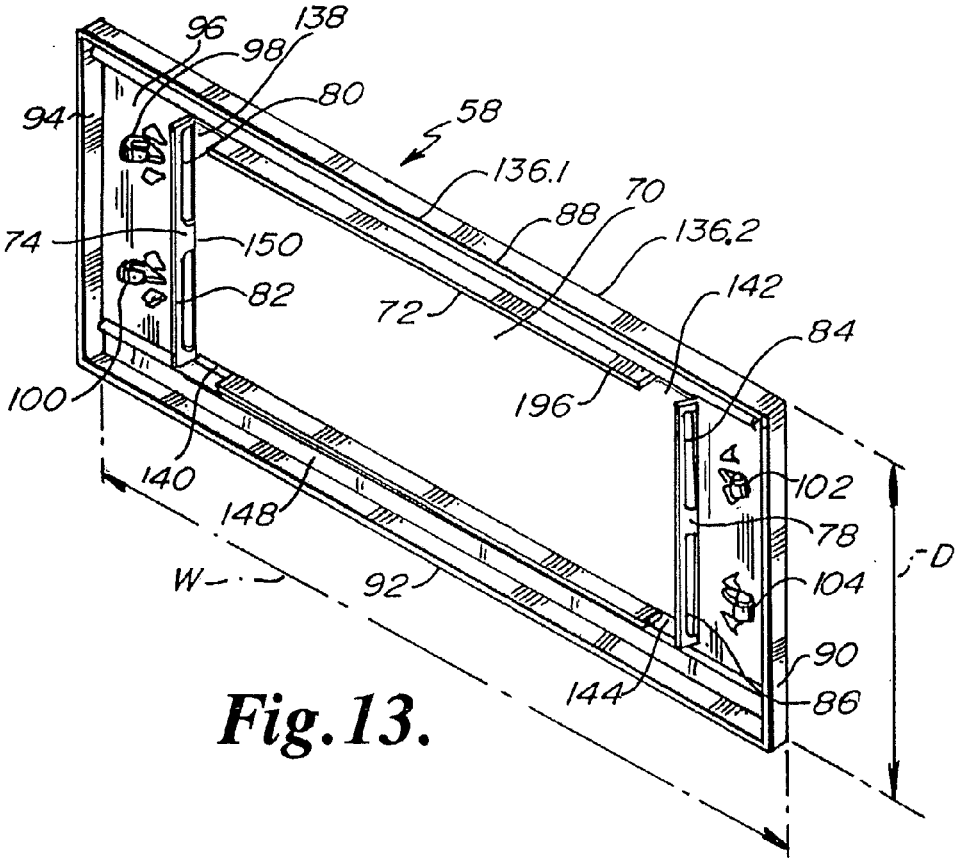
FIG. 13 is a bottom perspective view of the lower support plate.
Figure 16:
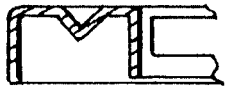
FIG. 16 is a side sectional view of portion 16—16 of FIG. 14.
Figure 14:
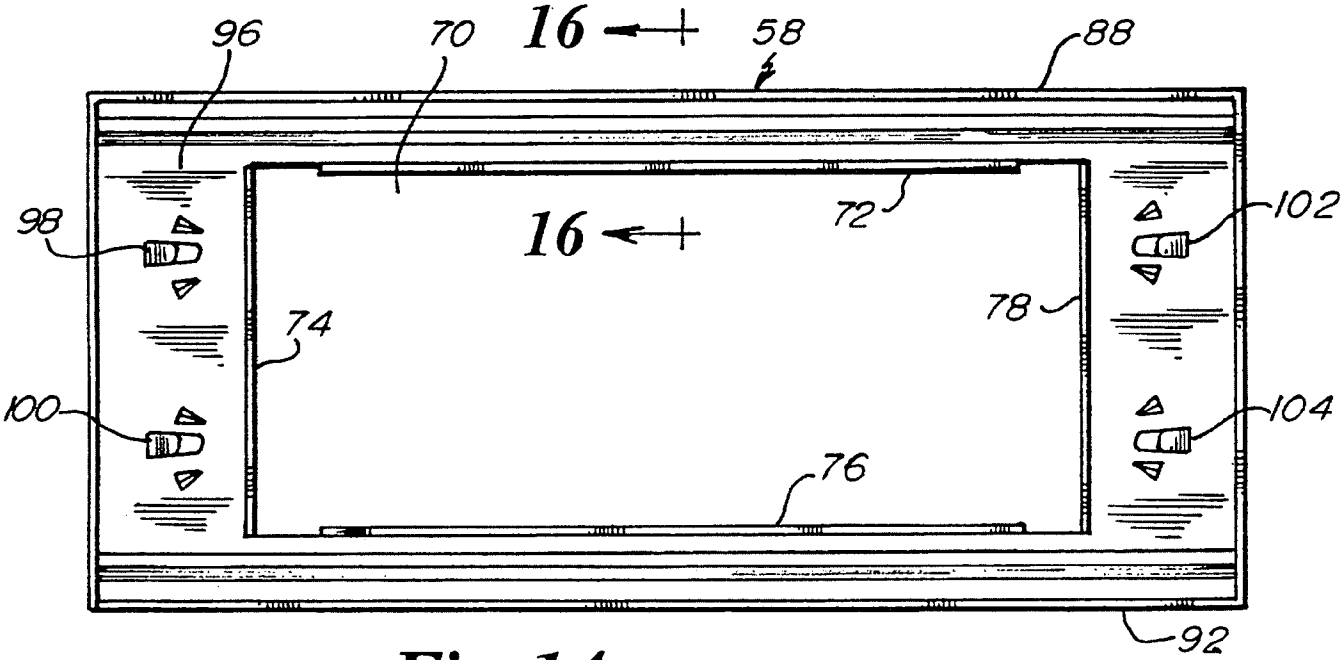
FIG. 14 is a top plan view of the lower support plate depicted in FIG. 13.
Figure 15:
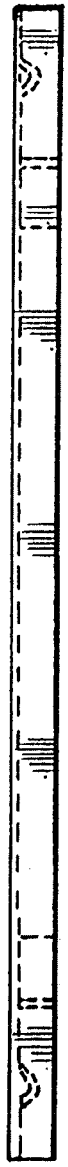
FIG. 15 is a side plan view of the lower support plate depicted in FIG. 13.

The lower support plate 58, as shown in FIGS. 13, 14, and 15, has a substantially rectangular opening 70 cut out of the body of the plate. Each edge created by the opening 70 forms a downwardly projecting flange portion 72, 74, 76, 78. Each end flange portion 74, 78 has two slots 80, 82 and 84, 86, contained therein. The exterior perimeter of the lower support plate 58 also has raised lips configured as downwardly projecting flange portions 88, 90, 92, 94 along all four sides of the plate. "Raised" when used herein means projecting away from the planar surface of the plate which can either normally or obliquely and includes upwardly or downwardly depending on the orientation of the plate. Hence, the lower support plate is not formed of any tubular sections. The lower surface 96 of the lower support plate 58 has a total of four curved tabs 98, 100, 102, 104 contained therein. Two curved tabs are located at each end of the lower support plate 58, proximate the end flange portions 74, 78, on the lower surface 96 of the lower support plate 58.

The upper support plate 68, as best shown in FIGS. 2, 3*b*, 6, 8, and 12, has a substantially rectangular opening 106 cut out of the body of the plate. Each edge created by the opening 106 forms an upwardly projecting flange portion 108, 110, 112, 114. Each end flange portion 108, 112 has two slots 116, 118, and 120, 122 contained therein. The exterior perimeter of the upper support plate 68 also has upwardly projecting flange portions 124, 126, along the length of the plate. The upper support plate, therefore, is not formed of any tubular sections. The upper surface 128 of the upper support plate 68 has a total of four curved tabs 130, 132, 134, 136 contained therein. Two curved tabs are located at each end of upper support plate 68, proximate the flange portion 108, 112 on the upper surface 128 of the upper support plate 68. Each end of the upper support plate 68 is welded to a flange portion 64, whose horizontal portion 66 is affixed to the upper surface 43 of a rocker cam 40, 42. Therefore, the upper support plate 68 connects the two rocker cams 40, 42. In addition, screws, bolts or the like, secure the end surfaces of the upper support plate 68 to the upper surface 43 of rocker cams 40, 42. The upper support plate assembly 52 comprises the upper support plate 68 and the flange portions 64 and including the horizontal portions 66 of the flange portions 64. Note that the upper support plate and lower support plate, with their raised lips both at the periphery and at the central opening is configured as two channels 139.1, 139.2, 139.3, 139.4 extending from each respective left plate portion 139.6, 139.7 to the right plate portion 139.8, 139.9.

The two pairs of springs 44, 46 and 48, 50 as shown in FIGS. 1–7 are tensioned in place, between the upper support plate 68 and lower support plate 58. The springs 44, 46 and 48, 50 provide a biasing force to bias the rocker cams 40, 42 to an upright position. Each spring 44, 46, 48, 50 is attached at its upper end directly to the upper surface 128 of upper support plate 68. Each spring 44, 46, 48, 50 is also attached at its lower end to the lower surface 96 of lower support plate 58 by integral attachment means in the respective plates.

As shown in FIG. 13, the hole or opening 70 in the lower support plate 58 may be formed by die-cutting. Tabs 138, 140, 142, 144, are cut into the longitudinal edges 146, 148 that form the length of opening 70 such that the tabs 138, 140, 142, 144 are located proximate the intersections of the longitudinal edges 146, 148 and lateral edges 150, 152. The extension flaps 72, 76 created by the tab cut-outs along the longitudinal edges 146, 148 are bent downwards to form flanges 72, 76. The extension flaps 74, 78 formed at the lateral edges 150, 152 are also bent downwards to form flanges 74, 78. Two slots 80, 82, 84, 86 are cut into each of the lateral edge flanges 74, 78 thus formed. On the lower surface 96 of the lower support plate 58 proximate lateral edge flange 74 are formed two curved tabs 98, 100. Two curved tabs 102, 104 are also formed on the lower surface 96 of the lower support plate 58 proximate lateral edge flange 78. The exterior side flanges 88, 92 and end flanges 90, 94 of the lower support plate 58 may be formed by bending the margins of a flat plate downwards.

Figure 12:
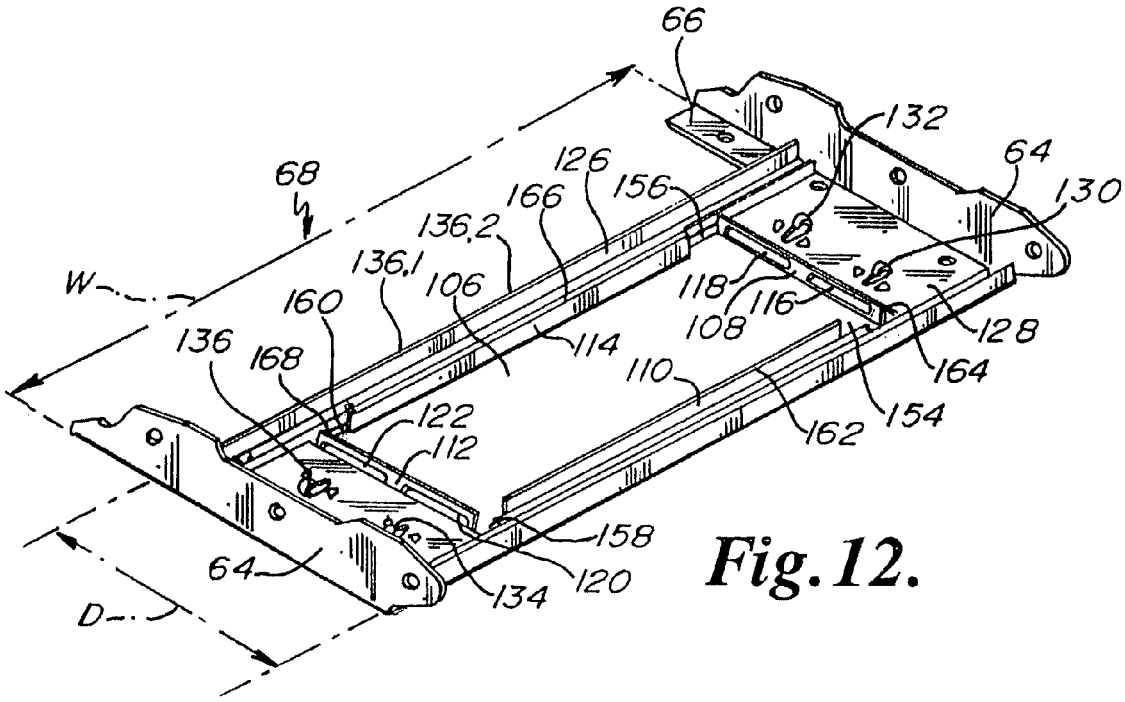
FIG. 12 is a perspective view of the upper support plate depicted in FIG. 8.

Referring to FIG. 12, the hole or opening 106 in the upper support plate 68 may also be formed by die-cutting. Tabs 154, 156, 158, 160, are cut into the longitudinal edges 162, 166 that form the length of opening 106 such that the tabs are located proximate the intersections of the longitudinal edges 162, 166 and lateral edges 164, 168. The extension flaps 110, 114 created by the tab 154, 156, 158, 160 cut-outs along the longitudinal edges 162, 166 are bent upwards to form flanges 110, 114. The extension flaps 108, 112 formed at the lateral edges 164, 168 are also bent upwards to form flanges 108, 112. Two slots 116, 118, 120, 122 are cut into each of the lateral edge flanges 108, 112 thus formed. On the upper surface 128 of the upper support plate 68 proximate lateral edge flange 108 are formed two curved tabs 130, 132. Two curved tabs 134, 136 are also formed on the upper surface 128 of the upper support plate 68 proximate lateral edge flange 112. The exterior side flanges 124, 126 the length of the upper support plate 68 may be formed by bending the margins of a flat plate upwards.

Referring to FIGS. 12 and 13, note that the upper support plate and lower support plate are configured substantially as trays with a lips 136.1 at their respective peripheries 136.2 and the centralized hole or opening that extends at least the majority of the width W and depth D of the plates.

Referring specifically to FIGS. 3*a*, 3*b*, 3*c*, the two pairs of springs 44, 46 and 48, 50 that are fitted between the upper support plate 68 and the lower support plate 58 are affixed to the surfaces of the two support plates by way of the curved tabs 98, 100, 102, 104, and 130, 132, 134, 136. For example, the upper free end of spring 48 is placed through slot 120 until it positioned in place by punched out nubs 137, 137.1. Tab 134 is bent over the end of the spring 48. Curved tab 134, the nubs 137, 137.1 and the slot 120 secures the spring 48 proximate the free end of the spring 48 to the upper surface 128 of the upper support plate 68 without separate fasteners. Likewise, the lower free end of spring 48 is placed, directly below, through slot 84 to curved tab 102. Curved tab 102 then secures the spring 48 proximate the free end of the spring, and so affixes the spring 48 to the lower surface 96 of the lower support plate 58. Weldments 137.4 secure the flange to the upper support plate. Screws 137.6 may secure the upper support plate and/or the flange to the rocker cam 42.

The other springs 40, 46, 50 are similarly affixed to the upper support plate 68 and the lower support plate 58. It is understood that the springs 44, 46, 48, 50, may be placed in any of the positions held by the springs between the upper support plate 68 and the lower support plate 58 and are attached to the upper support plate 68 and the lower support plate 58 through the positionally related slot and curved tab located above and below the spring. In other embodiments the springs may be in direct contact with upper and lower plate and be held in place with other attachment means such as clamp mechanisms utilizing screws or rivets. Alternatively they could be fixed with weldments.

A recliner mechanism 24 attaches to the outer side of the flange portion 64 of each rocker cam 40, 42. These recliner mechanisms 24 include flanges and brackets for attaching a chair frame 26 and a lazy tong linkage for attaching a footrest 36. The recliner mechanisms 24 are connected by an actuating shaft and a brace. The recliner mechanism also may include a "rocker blocker" (not depicted) for preventing rocking motion of the chair when the chair is in a reclined position.

The mechanism 22 of the present invention has important advantages over the prior art. The upper and lower support plates 68, 58, may provide improved overall rigidity to the mechanism, in turn improving comfort and longevity of the chair. Further, the use of springs 44, 46, 48, 50, that are directly attached to the upper support plate 68 and lower support plate 58 reduces the number of pieces making-up the rocker mechanism. Thus, the manufacturing process is simpler overall, and lower cost material may be used, leading to lower cost for the mechanism 22.

What is claimed is:

1. A method of manufacturing a rocker mechanism comprising the steps of;

fabricating a lower support plate from plate stock;

securing the lower support plate integrally to two floor engaging side rails thereby forming a base;

fabricating an upper support plate from plate stock;

securing the upper support plate to two L-shaped side flanges;

attaching a rocker cam to the lower side of the upper support plate at each side flange; and securing a plurality of bias springs to the upper support plate and to the lower support plate engaging the rocker cams attached to the upper support plate to the base.

2. The method of claim 1 further comprising the step of forming central holes in each of the upper support plate and lower support plate and providing elongate bent longitudinal edge flanges and lateral edge flanges on each of the upper support plate and lower support plate for providing rigidity.

3. The method of claim 2 further comprising the step of forming slots in each lateral edge flange of the upper support plate and the lower support plate.

4. The method of claim 3 further comprising the step of forming curved tabs in an upper surface of the upper support plate and in a lower surface of the lower support plate wherein an end of the bias spring is placed through the slot in the lateral edge flange and under the curved tab and affixed to the upper support plate and to the lower support plate.

5. The method of claim 1 further comprising the step of fabricating the lower support plate and the upper support plate by use of a punch press.

6. The method of claim 1 further comprising the step of welding the upper support plate to the two L-shaped side flanges.

7. A method of manufacturing a rocker mechanism comprising the steps of;

fabricating a lower support plate from material selected from the group consisting of plate stock and sheet metal;

securing the lower support plate integrally to two floor engaging side rails thereby forming a base;

fabricating an upper support plate from material selected from the group consisting of plate stock and sheet metal;

securing the upper support plate to two L-shaped side flanges;

attaching a rocker cam to the lower side of the upper support plate at each side flange; and securing a plurality of bias springs to the upper support plate and to the lower support plate engaging the rocker cams attached to the tipper support plate to the base.

8. The method of claim 7 further comprising the step of securing the rocker cam to the lower side of the upper support plate wherein the lower plate of the L-shaped flange is sandwiched between the lower side of the upper support plate and the rocker cam.

9. The method of claim 7 further comprising the step of fabricating the lower support plate and the upper support plate without the use of any tubular sections.

10. The method of claim 7 further comprising the step of forming central holes in each of the upper support plate and lower support plate and providing elongate bent longitudinal edge flanges and lateral edge flanges on each of the upper support plate and lower support plate for providing rigidity.

11. The method of claim 10 further comprising the step of forming slots in each lateral edge flange of the upper support plate and the lower support plate.

12. The method of claim 11 further comprising the step of forming curved tabs in an upper surface of the upper support plate and in a lower surface of the lower support plate wherein an end of the bias spring is placed through the slot in the lateral edge flange and under the curved tab and affixed to the upper support plate and to the lower support plate.

13. A method of manufacturing a rocker mechanism comprising the steps of;

fabricating a lower support plate from non-tubular metal material;

securing the lower support plate integrally to two floor engaging side rails thereby forming a base;

fabricating an upper support plate from non-tubular metal material;

securing the upper support plate to two L-shaped side flanges;

attaching a rocker cam to the lower side of the upper support plate at each side flange; and securing a plurality of bias springs to the upper support plate and to the lower support plate engaging the rocker cams attached to the upper support plate to the base.

* * * * *

UNITED STATES PATENT AND TRADEMARK OFFICE

CERTIFICATE OF CORRECTION

PATENT NO. : 7,150,087 B2
APPLICATION NO. : 11/184534
DATED : December 19, 2006
INVENTOR(S) : Gregory J. Maki and Michael J. Dotta It is certified that error appears in the above-identified patent and that said Letters Patent is hereby corrected as shown below:

Col. 2, line 9, delete the dash between “intermediate” and “the”

Col. 7, line 17, delete “tipper” and insert --upper--

Signed and Sealed this

Seventh Day of August, 2007

JON W. DUDAS
*Director of the United States Patent and Trademark Office*